US010480264B2

(12) United States Patent
McCorriston et al.

(10) Patent No.: US 10,480,264 B2
(45) Date of Patent: Nov. 19, 2019

(54) TRANSITIONING PIPE HANDLER

(71) Applicant: DRILLFORM TECHNICAL SERVICES LTD., Calgary (CA)

(72) Inventors: Todd McCorriston, Calgary (CA); Daniel Huvenaars, Tisdale (CA); Colin Irving, Tisdale (CA); Patrick McDougall, Calgary (CA); Ronald Pollard, Calgary (CA)

(73) Assignee: DRILLFORM TECHNICAL SERVICES LTD., Calgary (CA)

( * ) Notice: Subject to any disclaimer, the term of this patent is extended or adjusted under 35 U.S.C. 154(b) by 18 days.

(21) Appl. No.: 15/552,423

(22) PCT Filed: Feb. 22, 2016

(86) PCT No.: PCT/CA2016/050174

§ 371 (c)(1),
(2) Date: Aug. 21, 2017

(87) PCT Pub. No.: WO2016/134461

PCT Pub. Date: Sep. 1, 2016

(65) Prior Publication Data

US 2018/0045000 A1 Feb. 15, 2018

Related U.S. Application Data

(60) Provisional application No. 62/119,839, filed on Feb. 24, 2015.

(51) Int. Cl.
*E21B 19/00* (2006.01)
*E21B 19/15* (2006.01)

(52) U.S. Cl.
CPC ..... *E21B 19/155* (2013.01)

(58) Field of Classification Search
CPC ..... E21B 19/14; E21B 19/15
See application file for complete search history.

(56) References Cited

U.S. PATENT DOCUMENTS 2,558,554 A * 6/1951 Harvey ..... E21B 19/155 414/22.61
2,589,181 A * 3/1952 Yount ..... E21B 19/155 414/22.61

(Continued)

FOREIGN PATENT DOCUMENTS

CA 2873282 A1 * 11/2013 ..... E21B 19/155
CN 103089173 A 5/2013
GB 2137261 A * 10/1984 ..... E21B 19/15

OTHER PUBLICATIONS

Extended European Search Report for Application No. 16754693.6, dated Jul. 24, 2018.

(Continued)

*Primary Examiner* — Gregory W Adams
(74) *Attorney, Agent, or Firm* — Sheridan Ross PC

(57) ABSTRACT

An adaptable pipe transitioning system and method that can easily be used with drilling platforms varying in height is provided. The adjustable pipe handler includes a base having a surface forming a track for receiving at least one pipe, a lift arm having a first end being pivotally mounted to the front section of the base and a second end resting against the elevated platform, the lift arm being positionable at an incline from the base, and forming a channel operably corresponding to the track of the base for receiving the at least one pipe therefrom, and a transitioning arm, movably connected to both the base and the lift arm, for positioning the lift arm, the transitioning arm also forming a channel operably corresponding to the track of the base for receiving at least one pipe therefrom and guiding the pipe along the lift arm to the elevated platform.

11 Claims, 7 Drawing Sheets

(56) References Cited

U.S. PATENT DOCUMENTS 2,790,683 A * 4/1957 Clark ..... E21B 19/155 108/145
2,958,430 A * 11/1960 Robishaw ..... E21B 19/155 414/22.52
3,034,668 A * 5/1962 Wicks ..... A01G 25/09 414/508
3,159,286 A * 12/1964 Freeman, Sr. ..... E21B 19/155 414/22.61
3,169,645 A * 2/1965 Freeman, Sr. ..... E21B 19/155 414/22.59
3,706,347 A * 12/1972 Brown ..... E21B 19/15 173/164
3,780,883 A * 12/1973 Brown ..... E21B 19/15 175/85
3,785,506 A * 1/1974 Crocker ..... E21B 19/155 193/4
3,810,553 A * 5/1974 Crocker ..... E21B 19/155 414/22.61
3,956,901 A * 5/1976 Brown ..... E02F 5/223 405/184.5
4,067,453 A * 1/1978 Moller ..... E21B 19/155 175/85
5,522,699 A * 6/1996 Smith ..... F16L 1/036 405/174
6,722,931 B2 * 4/2004 Eberl ..... B60F 3/0061 14/2.6
7,992,646 B2 8/2011 Wright et al.
8,033,779 B2 * 10/2011 Gerber ..... E21B 19/15 14/71.1
8,052,368 B2 * 11/2011 Littlewood ..... E21B 19/15 414/22.52
8,764,368 B2 7/2014 Crossley et al.
8,840,352 B2 * 9/2014 Taggart ..... E21B 19/155 414/22.54
2007/0221385 A1 * 9/2007 Braun ..... E21B 19/155 166/379
2009/0053013 A1 2/2009 Maltby
2010/0163247 A1 7/2010 Wright et al.
2012/0027541 A1 * 2/2012 Gerber ..... E21B 19/15 414/22.58
2012/0121364 A1 5/2012 Taggart et al.
2013/0266404 A1 * 10/2013 Tolman ..... E21B 19/15 414/22.59
2014/0133939 A1 5/2014 Richardson et al.
2014/0238745 A1 8/2014 Dahmes et al.
2015/0139773 A1 5/2015 Nikiforuk
2015/0184472 A1 * 7/2015 Miranda ..... E21B 19/155 414/22.58

OTHER PUBLICATIONS

International Search Report & Written Opinion for PCT/CA2015/050174; 7 pgs.

* cited by examiner

TRANSITIONING PIPE HANDLER

CROSS-REFERENCE TO RELATED APPLICATIONS

This application claims priority to PCT Application No. PCT/CA2016/050174, having a filing date of Feb. 22, 2016, based off of U.S. Provisional Application No. 62/119,839 filed Feb. 24, 2015, the entire contents both of which are hereby incorporated by reference.

FIELD OF TECHNOLOGY

A pipe handling apparatus is provided. More specifically, a pipe handling apparatus that may be used as a catwalk in the oil and gas industry is provided.

BACKGROUND

It is well known that drilling platforms, often referred to as derricks, are positioned high above the ground to support and rotate long "strings" of pipe. Depending upon the type of operation, the work floor of the derrick can be anywhere from 5 to 30 feet above the ground, requiring that mechanical pipe handlers be used to raise and lower very large, heavy sections of pipe between the ground and the elevated derrick platform. During drilling operations, for example, tubular casing or drill pipe "tubulars" are lifted up to the rig floor and threaded together end-to-end to form the drill string. This process typically requires the reorientation of the tubulars from a horizontal storage position on the ground to a nearly vertical drill string position above the rig floor. Similarly, during break-down, each tubular must be removed from the platform, and reoriented back to a horizontal position for storage on the ground.

It is well known that the frequency of adding tubulars to the existing drills string is high and can be time consuming. It is also well known that such processes can involve manual handling of the piping and, therefore, can be quite dangerous to personnel working on or near the drill rig floor. As such, many mechanical pipe handlers have been designed to improve the efficiency of the process and to minimize the risk of hazardous incidents. For example, some pipe handlers, or "catwalks", for transitioning tubulars from the ground level up to the derrick platform are disclosed in U.S. Pat. Nos. 8,764,368, 7,992,646, and U.S. patent application Ser. Nos. 11/689,279, 12/193,309, and 13/968,424.

There is a need, however, for an adaptable pipe transitioning system that can easily be used with drilling platforms varying in height. It is desirable that such a system be simple and efficient, and utilized in either drilling or servicing operations. It is further desirable that such a pipe transitioning system comprise a unitary kicker/indexer system.

SUMMARY

An aspect relates to an adjustable pipe handler for use in transitioning pipe, such as tubulars, to elevated platforms varying in height.

Broadly speaking, an adjustable pipe handler for transitioning pipe to an elevated platform is provided, the pipe handler comprising: a base, having a front, middle and rear section, and having a surface forming a track for receiving at least one pipe, a lift arm having a first end and a second end, said first end being pivotally mounted to the front section of the base and said second end resting against the elevated platform, the lift arm being positionable at an incline from the base, and forming a channel operably corresponding to the track of the base for receiving the at least one pipe therefrom, and a transitioning arm, movably connected to both the base and the lift arm, for positioning the lift arm, the transitioning arm also forming a channel operably corresponding to the track of the base for receiving at least one pipe therefrom and guiding the pipe along the lift arm to the elevated platform.

Broadly speaking, a method of transitioning pipe to an elevated platform is also provided, the method comprising providing a pipe handling system having a base forming a track capable of receiving at least one pipe, a lift arm, pivotally connected to the base, for receiving the at least one pipe and guiding same to the elevated platform, and a transitioning arm, movably connected to both the base and the lift arm for controllably positioning the lift arm at an incline from the base and configured to transfer the at least one pipe from the base to the lift arm.

BRIEF DESCRIPTION

Some of the embodiments will be described in detail, with references to the following figures, wherein like designations denote like members, wherein.

DETAILED DESCRIPTION

An adjustable pipe handler or "catwalk" and method of use are provided for transitioning pipe to and from an elevated platform. It is understood that the present apparatus and methodologies may be used in the oil drilling and rigging industries, and other appropriate industries to assist with the handling of large, heavy pipes that are raised to and lowered from elevated platforms. According to embodiments herein, the present apparatus and methodologies provide a mobile transitioning catwalk capable of transferring at least one piece of large, heavy pipe from a generally horizontal storage position at or near the ground level to a near-vertical position above elevated platforms varying in height. The present system will now be described having regard to FIGS. 1-7.

Figure 1:
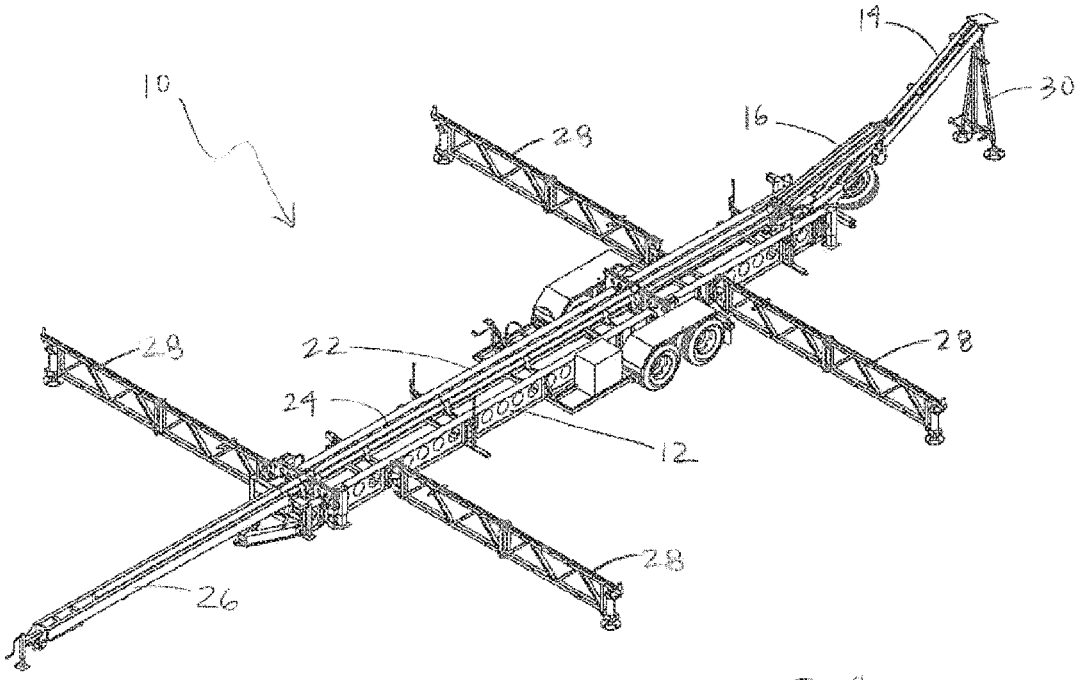
FIG. 1 is a perspective view of the present apparatus in an extended or "open" position according to embodiments herein.
Figure 2:
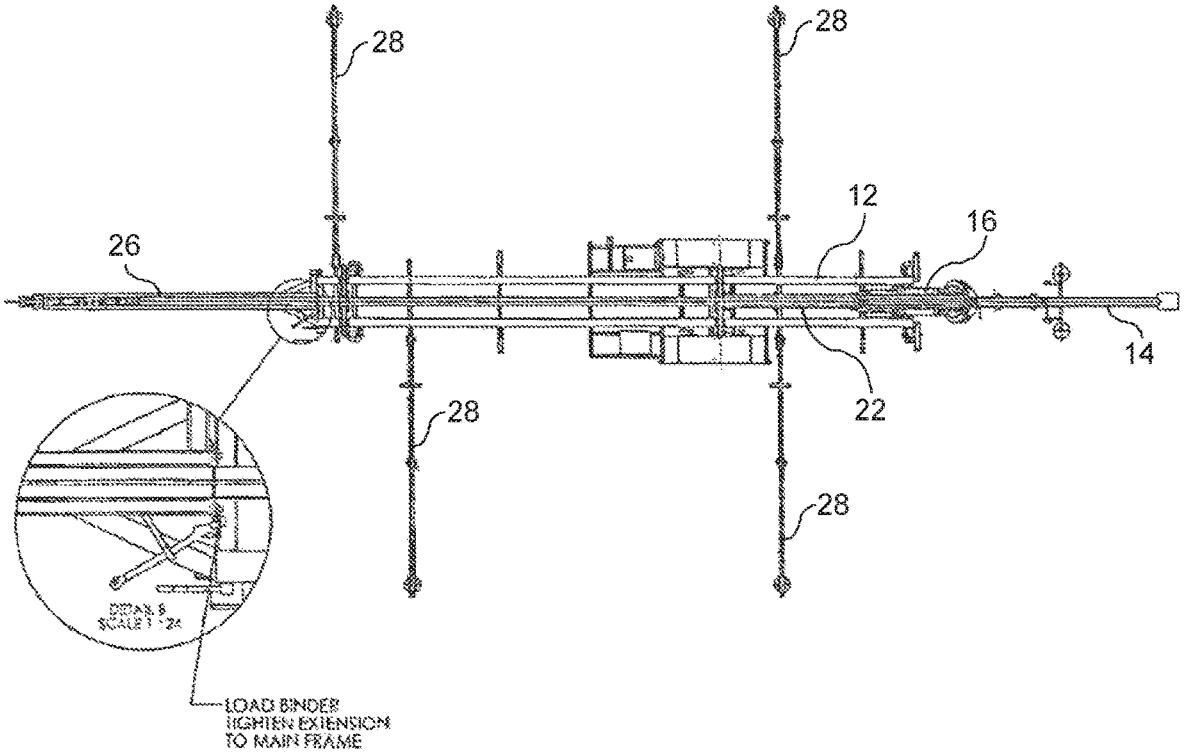
FIG. 2 is a top down view of the present apparatus shown in FIG. 1 according to embodiments herein.

Having regard to FIGS. 1 and 2, the present transitioning catwalk 10 generally comprises a base 12, a lift arm 14 and a transitioning arm 16. Catwalk 10 may be configured to be mobile (e.g. towed behind a vehicle) and conveniently transported between different elevated platforms, and can comprise anchoring means or device for securing base 12 (e.g. to uneven surfaces) during use. As will become apparent, it is an aspect of the present catwalk 10 that it may be utilized at elevated platforms varying in height (not shown).

In embodiments herein, the elevated platform may be at least five feet from the ground. In other embodiments, the elevated platform may be between approximately five and thirty feet from the ground. It is understood that the present transitioning catwalk may be automatically controlled, such that operating personnel may control the system remotely.

Figure 3:
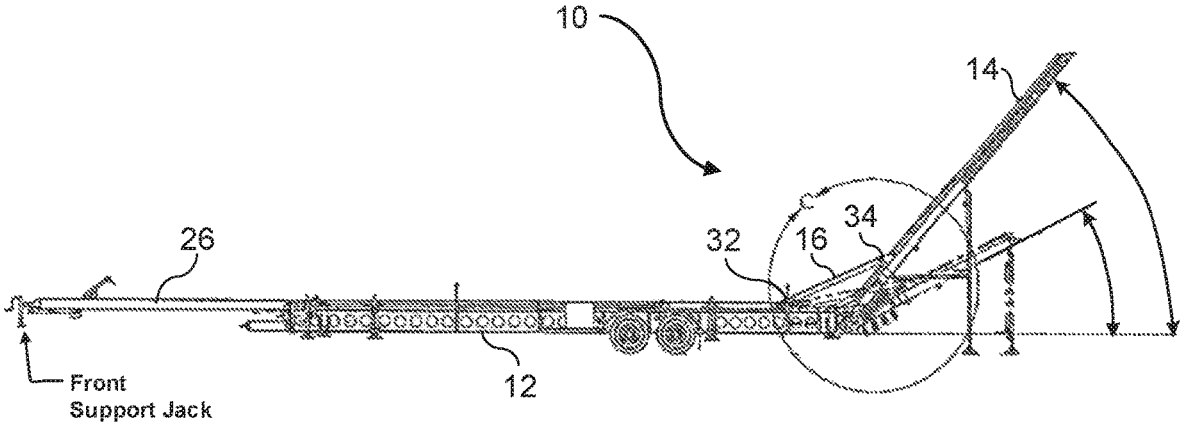
FIG. 3 is a side view of the present apparatus shown in FIGS. 1 and 2 according to embodiments herein.
Figure 4:
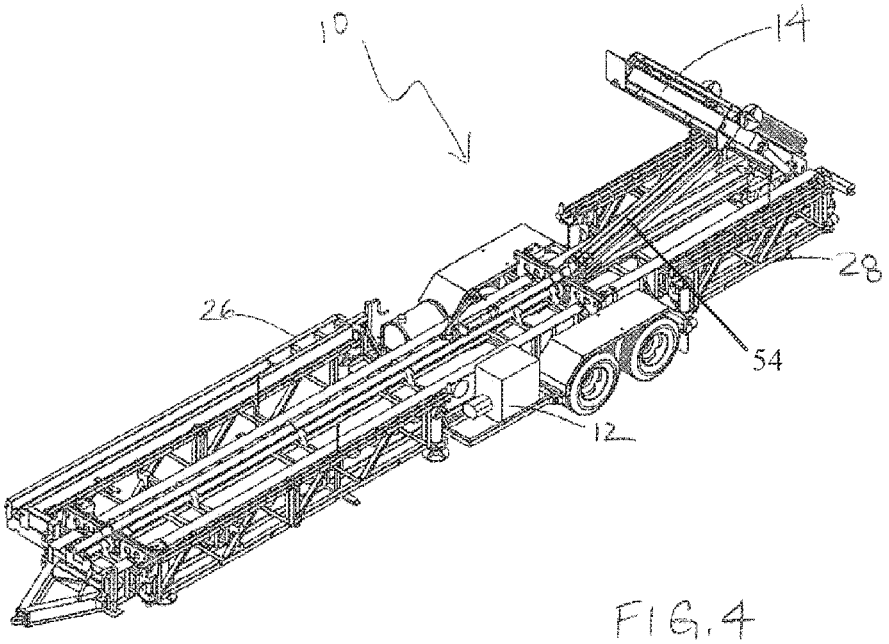
FIG. 4 is a perspective view of the present apparatus in a retracted or "closed" position according to embodiments herein.

Having regard FIG. 3, base 12 can comprise front, middle and rear sections. Without limitation, reference to the "front" section of the base 12 denotes the section of the base 12 closest to the elevated platform (not shown). Such reference to "front", "middle" and "rear" sections is made for explanatory purposes only and in no way is intended to limit the present apparatus and methodologies. Base 12 can further comprise a "U" or "V" shaped surface 22 forming a channel or "track" 24 for receiving at least one pipe element, such as a tubular pipe element. Track 24 may be arranged so as to generally extend the length of the surface 22 of the present pipe handler 10. Preferably, base 12 is configured without a platform or deck, enabling personnel to reach pipe in the track 24 (if necessary) from the ground and preventing personnel from mounting the base 12.

In one embodiment, base 12 may comprise at least one extension arm 26, operative to extend the surface 22 of the base 12. Without limitation, the at least one extension arm 26 may be utilized where it is desirable to connect more than standard pipe element end-to-end within the track 24 to make a longer pipe (e.g. where two range 2 tubulars are threaded together), or where longer tubulars (e.g. range 3, 45 ft pipe) are being transitioned to/from the platform.

The at least one extension arm 26 may be positioned at or near the rear end of the base 12. In one embodiment, extension arm 26 may comprise a folding section rotatable about a pivot joint connected to the base 12, such that extension arm 26 may swing out horizontally outwardly from a first "closed" position (e.g. stowed or nested against the side of the base 12) to a second "open" position co-axially aligned with longitudinal axis of the base 12. In another embodiment, extension arm 26 may comprise two diametrically opposed folding half-sections positioned on each side of the base 12, such that each half section is rotatably mounted to the base 12 at a pivot joint and swings horizontally outwardly away from the base 12 (and in opposite directions from each other) until they connect together to form one unitary extension arm 26 aligned with base 12. It is an aspect of the present apparatus and methodologies that the at least one extension arm 26 be configured so as to provide a small base 12 for easy transport. One or more extension arms 26 may comprise anchoring means or device as known in the industry for securing the extension arm 26 during use.

In one embodiment, base 12 may further comprise at least two diametrically opposed pipe supply racks 28. Supply racks 28 may contain a supply of pipes positioned in parallel alignment with the base 12 and track 24. It is understood that pipes can be arranged on supply racks 28 to enable alignment of opposite male and female pipe threading elements. In other words, pipes can be arranged so that all of the respective male, or as-called "pin" ends, and female ends are positioned in the same orientation.

The opposed pipe supply racks 28 may be positioned at or near the middle section of the base 12. In one embodiment, opposed pipe supply racks 28 are positioned to allow pipes to roll from the rack onto the surface 22 of the base 12 and into the track 24. As would be understood, the height of the pipe supply racks 28 may adjustable (e.g. using hydraulics) so as to raise and/or lower the racks relative to the height of the base 12. Adjusting the height of the pipe racks 28 may be automatically or manually controlled. In one embodiment, each diametrically opposed pipe rack 28 may comprise independently operated hydraulic lifts for raising/lowering the racks 28. It is contemplated that the present pipe handler 10 may comprise at least 2 diametrically opposed racks 28. In some embodiments, the present pipe handler 10 may comprise at least 4 or 6 diametrically opposed pipe racks 28, as determined by the length of pipe being used. Once positioned in the track 24, a skate may be used to raise the pipe to the elevated platform.

As above, the present pipe handler 10 further comprises a lift arm 14 having a first end and a second end. Having regard to FIGS. 4-6, the first end of lift arm 14 may pivotally mounted to the front section of the base 12, enabling the lift arm 14 to rotate from a "closed", nested positioned against the surface 22 of the base 12 upwardly and away from the base 12 to an "open" position where the second free end of the lift arm 14 rests against and cooperates with the elevated platform floor (not shown). Lift arm 14 may comprise a top surface forming a channel operably corresponding with track 24 of the base 12. In some embodiments, lift arm 14 may be extendable so as to reach the platform. For example, lift arm 14 may comprise at least one telescoping element enabling the second, "leading" end of the arm 14 to advance upwardly towards the platform floor. Extension of lift arm 14 may be driven by at least one hydraulic cylinder, such that the relative position of the telescoping elements may be locked at any desired position. Typically, the lift arm 14 is extendable up to heights desired in the industry, or as high as approximately 45 feet. It is understood that each telescoping element further comprises a surface forming a channel operably corresponding with track 24 of the base 12. Optionally, lift arm 14 may further comprise stabilizing arms 30 for supporting the lift arm 14 when in the raised, extended position.

As above, the present pipe handler 10 further comprises a transitioning arm 16 for controllably adjusting the pivotable transition of the lift arm 14 from the base 12 (i.e. from the closed to the open position). Transitioning arm 16 may comprise a first end and a second, wherein the first end may be connected to the base 12 and the second end may be connected to the lift arm 14. Transitioning arm 16 may be operative to controllably adjust the height of the lift arm 14, that is—to increase or decrease the incline of the lift arm 14 from base 12, enabling lift arm 14 to reach platforms of varying heights. As would be understood, transitioning arm 16 may be automatically controlled (i.e. via one or more hydraulic cylinders).

In one embodiment, the transitioning arm 16 is movably connected to both base 12 and lift arm 14. For example, in one embodiment, first end of transitioning arm 16 may be slidably connected to base 12, while second end of transitioning arm 16 may be pivotally connected to lift arm 14. It is understood that any movable connection of the transition arm 16 operative to enable controllable transition of the lift arm 14 from the base 12 is contemplated. It is further understood that transitioning arm 16 may further have a surface forming a channel operably corresponding with track 24 of the base 12 and lift arm 14, enabling smooth and uninterrupted guidance of a pipe element from the base 12 along the lift arm 14 and ultimately to the elevated platform, or in reverse from the lift arm 14 back to the base 12.

Figure 5:
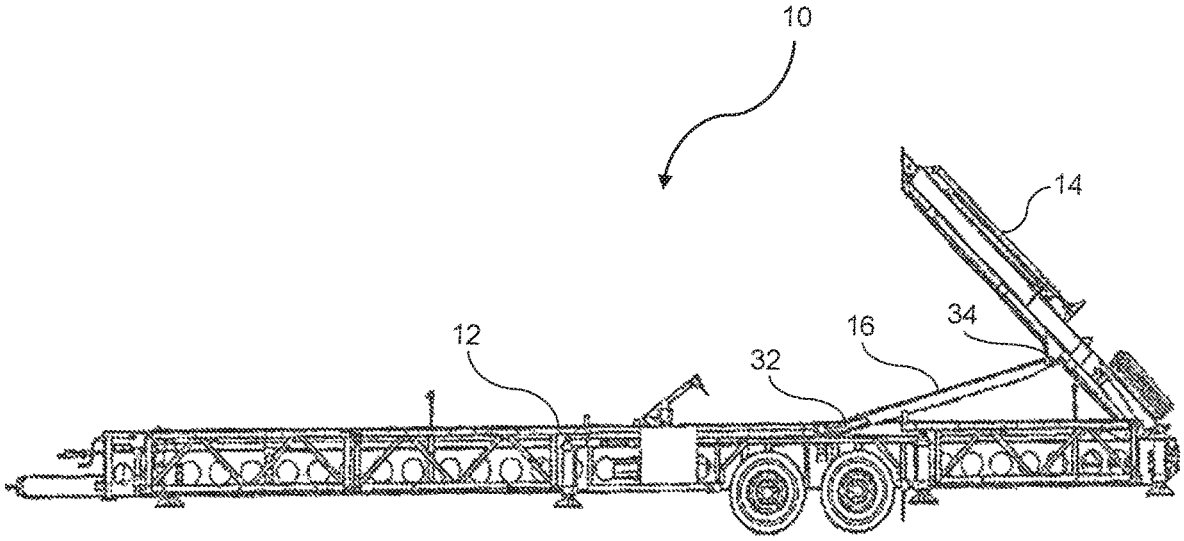
FIG. 5 is a side view of the present apparatus shown in FIG. 4 according to embodiments herein.
Figure 6:
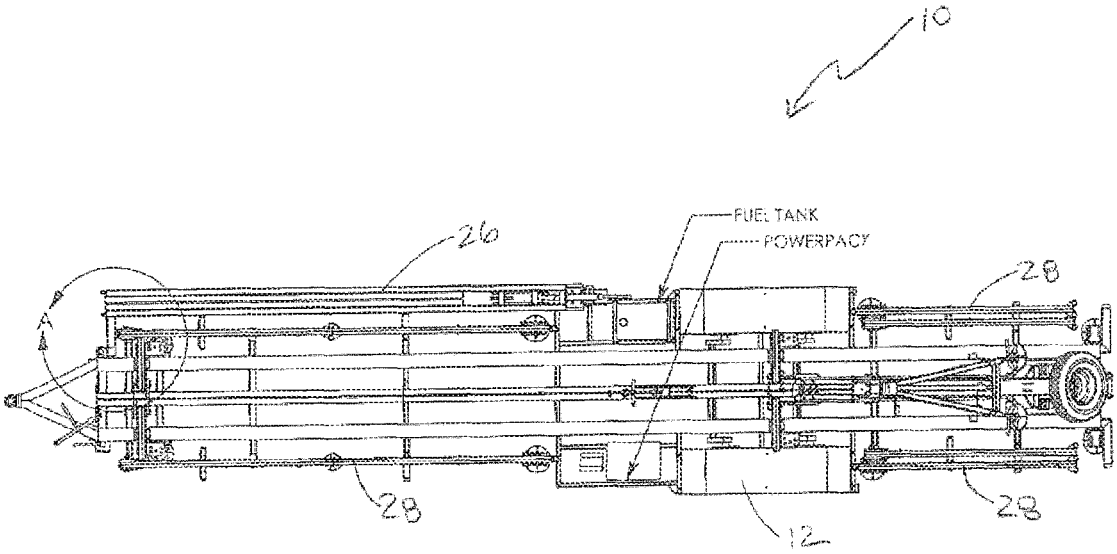
FIG. 6 is a top down view of the present apparatus shown in FIGS. 4 and 5 according to embodiments herein.

Having specific regard to FIG. 5, first end of transitioning arm 16 may be slidably connected to base 12 via a roller and track system 32, or any other such means or device for enabling smooth movement of the first end of the transitioning arm 16 back-and-forth along the surface 22 of the base 12. Second end of transitioning arm 16 may be rotatably connected to lift arm 14 by pivot 34, or any other such means or device as to enable smooth movement of the second end of the transitioning arm 16 and the lift arm 14. It would be understood that the location of the pivot 34 is determined for optimum movement of the lift arm 14. It is an aspect of the present apparatus that the lift arm 14 may extend at any desired angle from the base 12 to reach the elevated platform. Without limitation, as shown in FIG. 3, in some embodiments, it is contemplated that the lift arm 14 may extend from the base 12 at an angle of approximately 155° (or approximately 25° from the horizontal plane of the ground). In other embodiments, it is contemplated that the lift arm 14 may extend from the base 12 at an angle of approximately 40° from the base 12 (or approximately 140° from the horizontal plane of the ground).

Figure 7:
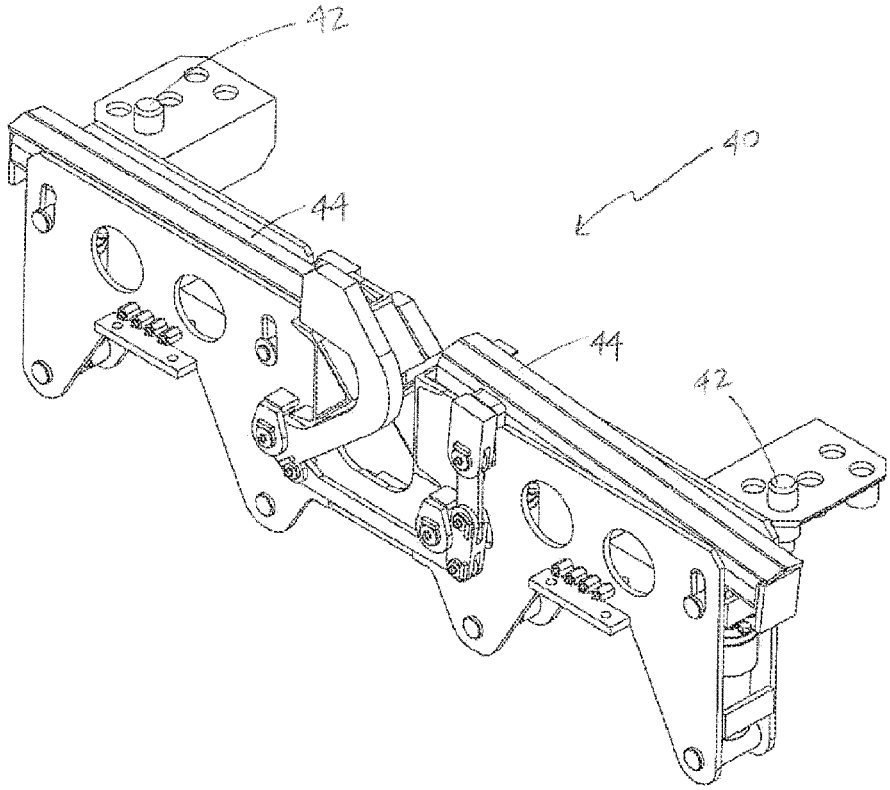
FIG. 7 is a perspective view of the unitary indexer and kicker of the present apparatus according to embodiments herein.

Having regard to FIG. 7, the present pipe handler 10 may further comprise a modified indexer and kicker elements 40. As is understood, an indexer is provided in conventional pipe handlers to move the pipe elements into the track 24 smoothly from the pipe supply racks 28, while kickers are provided to "kick" the pipe out of the track 24 for placement back on the supply racks 28 for storage.

According to embodiments herein, the base 12 of the present pipe handler 10 may be configured with at least one gap within which are provided combined indexer/kicker 40 for loading and unloading pipe. Each indexer/kicker 40 may be configured to provide mirrored indexing elements 42 and kicking elements 44 (i.e. on opposite sides of track 24), such that pipes within the indexer/kicker 40 can be smoothly transitioned into or out of track 24 in either direction, that is—to pipe racks 28 on either side of the pipe handler 10. Indexer/kicker 40 can comprise a frame enabling each indexer/kicker 40 to be removably attached to the pipe handler 10 for easy handling by those skilled in the art.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. An adjustable pipe handler for transitioning pipe to an elevated platform, the pipe handler comprising:

a base, having a front, middle and rear section, and having a surface forming a track for receiving at least one pipe, a lift arm having a first end and a second end, said first end being pivotally mounted to the front section of the base and said second end for contacting the elevated platform, the lift arm being pivotable between a first closed position on the surface of the base and a second open position at an incline from the base, the lift arm forming a first lift arm channel operably corresponding to the track of the base for receiving the at least one pipe therefrom, and a transitioning arm, having a first and second end, the first end pivotally connected to the lift arm and the second end slidably connected to the base, the transitioning arm forming a second transitioning arm channel operably corresponding to the track of the base for receiving at least one pipe therefrom and guiding the pipe to the first lift arm channel and to the elevated platform, wherein movement of the transitioning arm along the base controllably adjusts the height of the lift arm relative to the elevated platform.

2. The pipe handler of claim 1, wherein the lift arm further comprises at least one telescoping element for extending the length of the lift arm.

3. The pipe handler of claim 1, wherein the base further comprises at least one extension arm for extending the length of the base and the track.

4. The pipe handler of claim 3, wherein the extension arm is connected to the rear section of the base.

5. The pipe handler of claim 1, wherein the pipe handler further comprises at least two diametrically opposed pipe supply racks.

6. The pipe handler of claim 1, wherein the elevated platform is approximately at least 5 feet in height.

7. The pipe handler of claim 6, wherein the elevated platform is between approximately 5-30 feet in height.

8. The pipe handler of claim 1, wherein the incline of the lift arm may be at least approximately 40° from the base.

9. The pipe handler of claim 1, wherein the incline of the lift arm may be between 40°-155° from the base.

10. The pipe handler of claim 1, wherein the pipe handler further comprises at least one unitary indexer and kicker.

11. A method of transitioning pipe to an elevated platform, the method comprising:

providing a pipe handling system having:

a base having a surface forming a track for receiving at least one pipe, a lift arm pivotally connected to the base between a first closed position on the base to a second open position at an incline from the base, for receiving the at least one pipe and guiding same to the elevated platform, and a transitioning arm having a first end and a second end, the first end pivotally connected to the lift arm and the second end slidably connected to the base, moving the transitioning arm along the base to controllably adjust the incline of the lift arm from the base, and transitioning the at least one pipe from the base to and from the elevated platform.

* * * * *